United States Patent [19]

Rock et al.

[11] Patent Number: 4,515,734

[45] Date of Patent: May 7, 1985

[54] FUEL EFFICIENT, LOW POLLUTION CARBURETOR AND METHODS

[76] Inventors: Howard P. Rock; Kelly P. Rock, both of 5034 Del Rio, Salt Lake, Utah 84117

[21] Appl. No.: 461,847

[22] Filed: Jan. 28, 1983

[51] Int. Cl.[3] ..... F02M 23/12

[52] U.S. Cl. ..... 261/50 R; 261/121 A; 261/69 R; 261/79 R; 261/DIG. 21

[58] Field of Search ..... 261/50 R, 121 A, DIG. 21, 261/69 R, 79 R

[56] References Cited

U.S. PATENT DOCUMENTS

| | | | |
|---|---|---|---|
| 1,147,644 | 7/1915 | Reichenbach | 261/DIG. 21 |
| 1,729,382 | 9/1929 | Harel | 261/121 A |
| 1,731,123 | 10/1929 | Brut | 261/121 A |
| 1,889,126 | 11/1932 | Malin | 261/121 A |
| 1,927,090 | 9/1933 | Hess | 261/79 R |
| 2,536,700 | 1/1951 | Russell | 261/79 R |
| 3,263,974 | 8/1966 | Braun et al. | 261/50 A |
| 3,485,482 | 12/1969 | Fuchs | 261/121 A |
| 3,640,512 | 2/1972 | Morgenroth | 261/50 R |
| 3,933,952 | 1/1976 | Elmore | 261/50 R |
| 3,944,634 | 3/1976 | Gerlach | 261/79 R |

FOREIGN PATENT DOCUMENTS

| | | | |
|---|---|---|---|
| 617405 | 11/1926 | France | 261/121 A |
| 370487 | 4/1932 | United Kingdom | 261/79 R |

*Primary Examiner*—Tim Miles

*Attorney, Agent, or Firm*—Lynn G. Foster

[57] ABSTRACT

An engine carburetor and related methods, the disclosed carburetor comprising (a) an atomizing section comprising several fuel/air mixing sites where a high degree of vaporization and homogenization is achieved, (b) a crankcase fume recycling section, (c) a main air intake section, (d) a fuel metering section and (e) an excess fuel removal and fuel recycling section.

7 Claims, 8 Drawing Figures

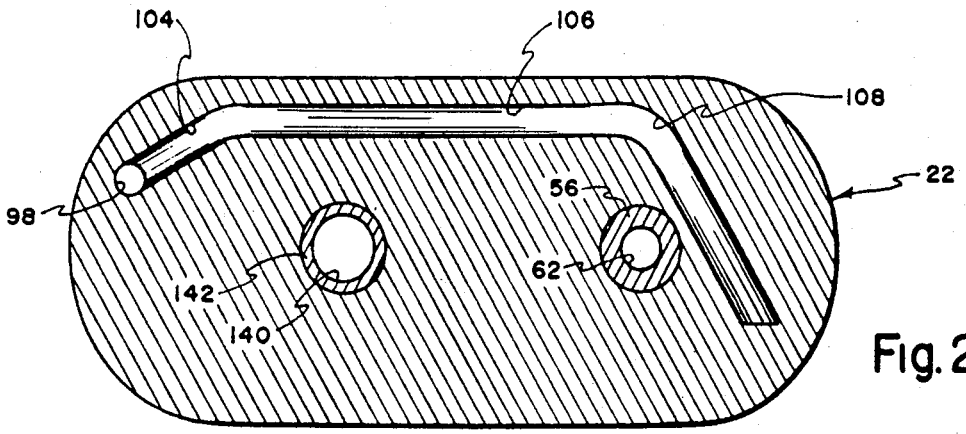
Fig. 2
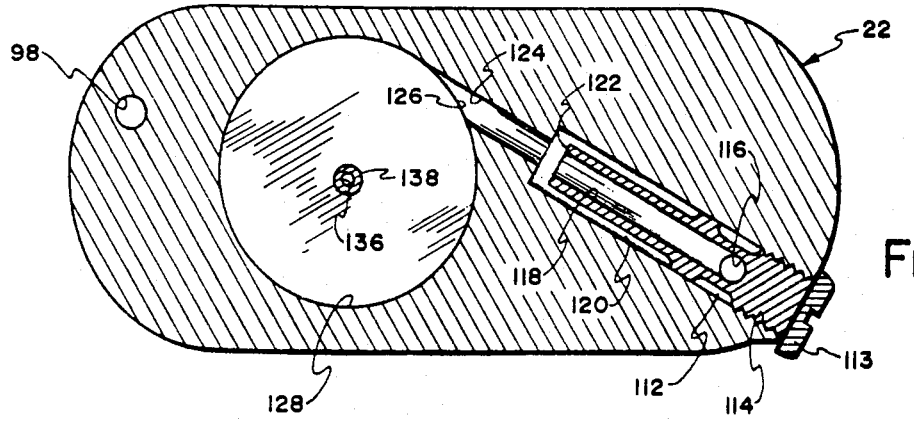
Fig. 3
| |
|---|
| Fig. 1A |
| Fig. 1B |
Fig. 1

FUEL EFFICIENT, LOW POLLUTION CARBURETOR AND METHODS

BACKGROUND

1. Field of Invention

The present invention relates generally to internal combustion engines and more particularly to an improved fuel efficient, low pollution carburetor and related methods.

2. Prior Art

The known prior art is only of general interest; consisting of U.S. Pat. Nos. 3,273,161; 3,336,017; 3,667,221; 3,866,585 and 4,106,453. As is evident from an examination of the prior art, it has long been an objective of the industry to provide carburetors and the like having improved fuel efficiency and a low pollution discharge to the atmosphere from associated internal combustion engines. Cyclonic circulation has been variously relied upon for diverse purposes in the prior art. The prior efforts have been deficient in one or more of the following ways: required complex and expensive equipment ancillary to the carburetor; recycled large quantities of exhaust; required circuitous cyclonic pre-carburetor mixing of air, exhaust and fuel with no control over introduction or removal of excess fuel in the mixture; requires pre-heating of air and/or fuel in some fashion to enhance vaporization; failed to effect total homogeneous vaporization of the fuel; failed to minimize pollutants discharged into the atmosphere; failed to provide appropriate automatic adjustments in the fuel/air ratio during normal operations, during acceleration and during coasting; reintroduced excess fuel, once separated, from the fuel/air mixture into the intake manifolds; drained fuel removed from the fuel/air mixture into the intake manifold during and immediately following start-up; did not effectively recycle excess fuel from the fuel/air mix; did not separate and remove unvaporized fuel from vaporized fuel before introduction into the intake manifold; utilized only one air/fuel atomizing site; usually directly adjacent and directly feeding into the primary air supply; and utilized a turbulent cone mixing chamber in lieu of a standard carburetor.

BRIEF SUMMARY AND OBJECTS OF THE INVENTION

In brief summary, the present invention comprises a novel internal combustion engine carburetor system and related methods providing for significantly improved atomization and vaporization of fuel and air turbulently achieved at a plurality of sites prior to being comingled with the primary influent carburetor air. Also, excess fuel, which would otherwise decrease efficiency and pollute the air, is cyclonically removed downstream of the primary air intake site but upstream of the intake manifold and thereafter recycled. The metered fuel/air ratio is automatically varied to efficiently start the engine, accelerate, coast and operate under steady state conditions. Engine fumes may be recycled to reduce air pollution.

It is an important object of the present invention to provide a novel and improved carburetor system and related methods for an internal combustion engine.

It is a further paramount object to provide an improved carburetor and methods whereby fuel mixed with air is turbulently atomized, homogenized and vaporized at a plurality of sites prior to being comingled with the primary carburetor intake air.

It is another dominant object to provide an improved carburetor and methods wherein fuel is automatically metered during start up, under steady state conditions, while accelerating and during coasting to efficiently conserve fuel.

Another valuable object of this invention is the provision for recycling fumes through the carburetor system to better control discharge of pollutants to the atmosphere.

A further object is the provision for removal and recycling of excess and unneeded fuel cyclonically from the fuel/air mixture at a carburetor site just prior to introduction of the fuel/air mixture into the intake manifold of an internal combustion engine.

It is an important object of the present invention to provide a novel carburetor system and related methods for an internal combustion engine having one or more of the following features:

utilizes relatively low combustion temperatures because pre-heating of air and/or fuel is not needed; alleviates air pollution and enhances fuel economy; produces a marked improvement in carburetor fuel vaporization and homogenization; increases air flow at multiple vortical turbulent mixing sites to improve fuel atomization and vaporization; is relatively economical to manufacture and install and is adapted to be installed in conjunction with existing carburetor systems; increases volumetric and thermal efficiencies; delivers the proper fuel/air mixture at all speeds and under all operating conditions; causes almost total burning of all hydrocarbons in the associated engine; cyclonically recycles excess fuel within the fuel/air mixture upstream of the intake manifold; utilizes a cool air/fuel charge at the intake manifold; leaves at shutdown, residual fuel at a location which fuel is almost instantaneously delivered to the engine at start-up to minimize the time, energy and fuel required to cause the engine to again operate.

These and other objects and features of the present invention will be apparent from the detailed description taken with reference to the accompanying drawings.

BRIEF DESCRIPTION OF THE DRAWINGS

FIG. 1 graphically illustrates the manner in which FIGS. 1A and 1B relate one to the other;

FIG. 2 is a cross sectional view taken along line 2—2 of FIG. 1B;

FIG. 3 is a cross section taken along lines 3—3 of FIG. 1B;

DETAILED DESCRIPTION OF THE ILLUSTRATED EMBODIMENT

Figure 1A:
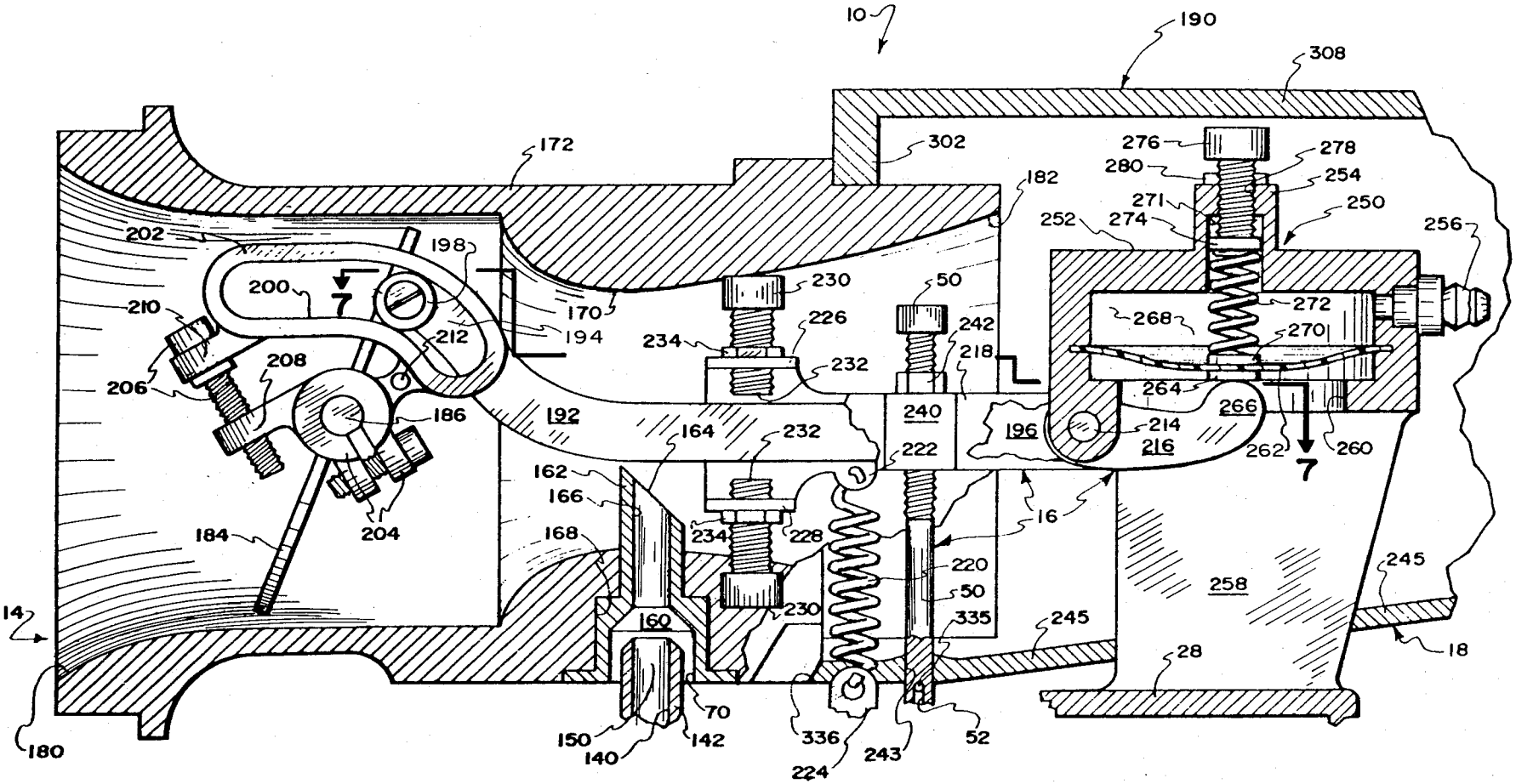
FIG. 1A is an enlarged cross sectional view of the upper portion of a presently preferred carburetor according to the present invention.

Reference is now made to the drawings wherein like numerals are used to designate like parts throughout and which illustrate a presently preferred carburetor, generally designated 10, in accordance with the present invention. Carburetor 10 comprises a fuel atomizing section, generally designated 12 (FIG. 1B), a main air section, generally designated 14 (FIG. 1A), a fuel metering section, generally designated 16 (FIG. 1A), a fuel recycling section, generally designated 18 (FIG. 1A) and a crankcase fume recycling section, generally designated 20 (FIG. 1B).

Figure 1B:
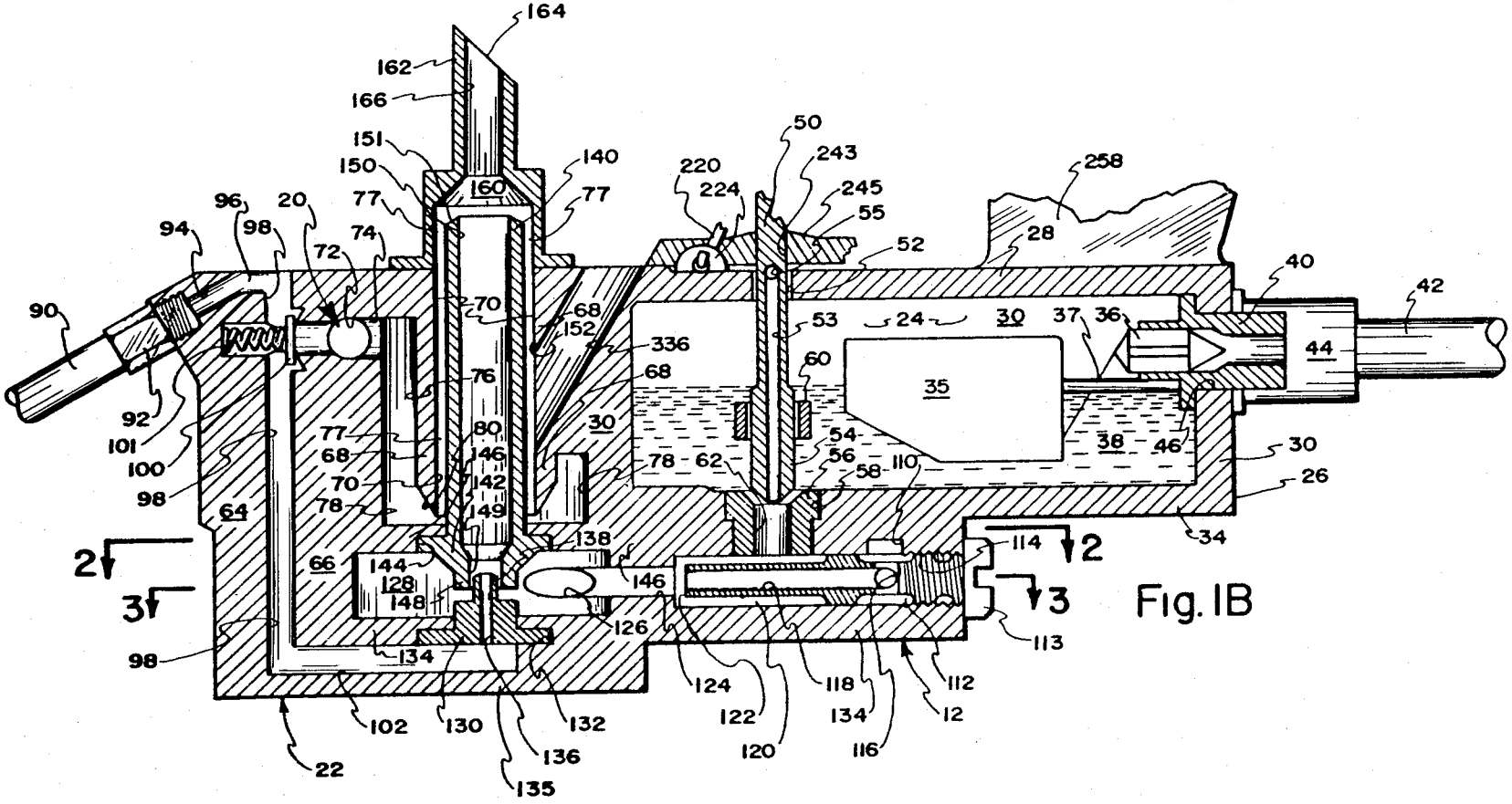
FIG. 1B is an enlarged longitudinal cross sectional view of the lower portion of the carburetor of FIG. 1A.

Carburetor 10 is illustrated as comprising a lower body portion, generally designated 22, body 22 is illustrated in FIG. 1B as being formed from a single piece of stock material. However, if desired using conventional methods, more than one piece of material may be used to fabricate body 22.

Body 22 defines a hollow fuel chamber 24 formed by a fuel float bowl 26 comprising top wall 28, four sidewalls 30 and bottom wall 34. A float 35 is centrally disposed within chamber 24 and is conventionally connected at 37 to a needle valve 36, which is conventionally displaced by up and down movement of the float 34 responsive to the quantity of fuel 38 contained within the chamber 24 in respect to the fuel valve seat 40 to enable and disable, respectively, the flow of fuel under pressure into the chamber 24 from fuel line 42. The fuel flow through a conventional fitting 44 suitably connected to the wall 32 and the hollow interior of the seat 40. Seat 40 is tightly contiguously retained in the illustrated position and extends through an elevated aperture 46 in the right side wall 30. Thus, a predetermined amount of fuel 38 is essentially retained in the chamber 24 at all times.

A metering and air atomizing rod 50 comprising part of the fuel metering section 16 and part of the atomizing section 12 slidably passes through an aperture 52 in the top wall 28. Sufficient space exists between the rod 50 and the aperture 52 to keep the chamber 24 at atmospheric pressure. The lower end 54 of the rod 50 comprises a hollow tip valve 54, which is displaced up and down by the fuel metering system 16, as hereinafter more fully described, to regulate, and in some cases eliminate the flow of fuel from the chamber 24. Air is introduced from the atmosphere into the lower hollow interior of the rod 50 at port 55. This air is displaced in a vortical spinning turbulent pattern downwardly within the annular hollow interior 53 at the lower end of the rod 50 to the valve tip 54 where the air is mixed with fuel as hereinafter explained in greater detail.

A hollow valve seat 56 is snugly retained in fluid tight relation within an aperture 58 in the bottom wall 34. The hollow valve seat 56 is in axial alignment with the rod 50 and more particularly with the hollow valve tip 54 thereof. A collar 60 loosely surrounds the valve end 54 and maintains the indicated alignment between the rod 50 and the hollow valve seat 56. The collar 60 is suitably secured in the illustrated position by conventional attachment to the adjacent wall 30 forming the chamber 24.

Thus, when the lower end of the valve 54 is contiguous with the valve seat 56, no flow of fuel through the hollow 62 of the valve seat 56 occurs. When a space exists, that space is varied by the previously mentioned fuel metering system 16 in a manner hereinafter explained to correspondingly deliver varying amounts of fuel to the fuel atomizing system 12. Turbulent mixing of said fuel and air issuing from nozzle passage 53 occurs in hollow 62.

The atomizing carburetor section 12 is disposed substantially entirely within the lower body 22 and comprises the mentioned hollow mixing seat 56, a vertically directed exterior wall 64, an intermediate wall 66 and interior annular wall 68. The annular interior wall 68 defines a hollow central interior 70.

Disposed within the intermediate vertical wall 66 are connected perpendicular circular passageways 72 and 74. Passageway 74 selectively communicates with passageway 98 across check valve 100, in a manner and for a purpose hereinafter explained. Passageway 74 continuously communicates with the upper end of the vertical passageway 76 which is connected at its lower end to a hollow annulus 78 interposed between the interior annular wall 68 and the walls 30 and 66, respectively. The annulus 78 communicates with an annular chamber 77 within bore 70 across the lower bevelled end 80 of the annular wall 68. As hereinafter more fully explained, air (infiltrated with crankcase fumes being recycled) is delivered by a suitable hose (not shown) which is in fluid communication with the interior of the crankcase to the passageway 72 and thence along passageways 74 and 76, across bevelled end 80 and into annular chamber 77 for recycling and pollution-reduction or elimination purposes.

Under conditions of substantially uniform RPM, the pressure within passageway 74 exceeds the counter force of spring 101 causing check valve 100 to open. In this condition, a second charge of atomizing air is delivered to the carburetor 10 under pressure through passageway 74, across open valve 100 and into passageway 98. The mentioned atomizing air is thence displaced along passageway 98 to a chamber 102 above a bottom wall 135 of the body 22.

As best illustrated in FIG. 2, bore 98 also communicates a bifurcated portion of said second charge of atomizing air under pressure seriatim along bores 104, 106 and 108, with bore 108 communicating with port 110 (FIG. 1B).

Atomizing air under pressure passes from port 110 into an annular chamber 112 formed in a second nozzle 113 secured in the illustrated position at threaded bore 114 in body 22. Atomizing air under pressure passes from the annular chamber 112 through a radial port 116 into the axial bore 118 of the nozzle 113.

Fuel and air turbulently issue from the chamber 62 of the valve 54 along the exterior of the nozzle 113 at an annular chamber 120 and is displaced therealong turbulently and vortically. Air moves through the passageway 118 vortically and turbulently and upon leaving the passageway 118 is dynamically mixed with fuel and air issuing from annular chamber 120 at nozzle end 122. The resulting air/fuel mixture is again turbulently and vortically displaced under pressure of incoming atomizing air along linear bore 124 in the body 22. Bore 124 has a diameter substantially the same as the diameter of the bore 118. Thus, the rate of displacement of the air/fuel mixture is increased through bore 124.

The air/fuel mixture is thence introduced tangentially at opening 126 into a small vortical chamber 128 where it is caused to vortically spin in such a fashion as to further homogenize the atomized fuel/air mixture passing therethrough. See especially FIG. 3.

A third nozzle 130 is disposed in air tight relation in stepped aperture 132 in horizontal wall 134. Wall 134 extends between the atomizing air chamber 102 and the small vortex chamber 128. Nozzle 130 comprises a central bore 136 and a stepped exterior the cantilevered end of which projects above the wall 130 terminating in discharge pipe 138. The nozzle 130 is in axial alignment with the hollow interior 70 formed by the annular wall 68.

The nozzle 130 is also in axial alignment with a hollow recycle mixing tube 140. Tube 140 is cantilever secured at its lower constricted end 142 in contiguous relation in stepped aperture 144 of horizontal wall 146 which exists between the small vortex chamber 128 and the crankcase fume recycle chamber 77.

The lowest part 148 of the recycle tube 140 is of reduced diameter, the inside diameter 149 of which is slightly greater than the outside diameter of the nozzle tube 138. Thus, a small air space exists therebetween through which the atomizing air/fuel mixture being vortically and centrifugally homogenized in small vortex chamber 128 is caused to pass at an accelerated speed as further atomizing air is simultaneously caused to be vortically displaced from air intake chamber 102 through the hollow center 136 of the nozzle 130. This phenomena further turbulently mixes and thereby substantially increases the homogeneous nature of the fuel-/air mixture as it moves along the hollow interior 150 of the tube 140.

The exterior diameter of the tube 140 is less than the hollow interior 70 of the annular wall 68 so as to define the hollow annular passageway 77 therebetween. Thus, air (with recycled crankcase fumes) and return fuel (caused to be present in the annular space 152 in a manner hereinafter more fully explained) are caused to be vortically displaced upwardly along chamber 77 by pressure differential caused by turbulent displacement of the fuel/air mixture through the tube 140, the air and return fuel from chamber 77 merging with the fuel/air mixture at the upper cantilevered end 151 of the tube 140 in mixing chamber 160.

The flow of recycled fuel, recycled crankcase fumes and the homogeneous highly atomized air/fuel mixture issuing from the interior 150 of the tube 140 are thus further mixed and further homogenized within the chamber 160 and along the interior 166 of reduced diameter venturi feed tube 162, the upper end of which is bevelled at 164. The venturi feed tube 162 is exteriorly and interiorly stepped so as to form a continuation of the previously mentioned passageway 77 as well as the chamber 160. The stepped exterior of the tube 162 fits and is retained in air tight contiguous relation within a correspondingly shaped stepped aperture 168 (FIG. 1A) adjacent the throat 170 of main air venturi housing 172.

The flow of air through the venturi 170 aids and assists in drawing the homogenized and atomized mixture of fuel, air, fumes and recycled fuel from the tube 160 to into the throat 170. It is to be observed that the upper end 162 of the venturi feed tube 162 extends a substantial distance into the throat 170.

From the foregoing, it is readily apparent that the homogenization and mixing of fuel and air occurs at several stages at different sites in the atomization section 12 prior to introduction into the venturi 170, i.e. at the downstream end of valve 54, at the downstream end of second nozzle 113, along passage 124, within the small vortex chamber 120, at the effluent end of the third nozzle 130, along the interior 150 of the tube 140, at the upper end of the tube 140 within chamber 160 and along the interior 166 of the tube 162.

The main air section 14 (FIG. 1A) comprises the mentioned air horn or main venturi housing 172 which has an enlarged interior intake opening 180, the previously mentioned throat 170 and an enlarged discharge opening 182. A conventional butterfly valve plate 184 is within the hollow interior of the housing 172 approximately midway between the intake opening 180 and the throat 170. The plate 184 is conventionally and non-rotatably secured to a central shaft 186 which is disposed in a horizontal attitude transverse to the direction of the flow of air through the interior of the housing 172, whereby rotation of the shaft 186 likewise will adjust to the angle of inclination of the plate 184 within the interior of the housing 172. It is to be appreciated that any suitable type of main air venturi structure may be used in conjunction with the present invention. Also, the main air flow issuing from the effluent opening 182 and carrying with it the atomized and homogeneous fuel/air/fume mixture issuing from the tube 162 passes tangentially into a fuel separating cyclone housing 190, which housing 190 comprises part of the fuel recycling section 18.

The fuel metering system 16 (FIG. 1A and 1B) comprises an elongated metering arm 192 which has a reverse curve trailing end 194 and a linear forward end 196. Trailing end 194 rotatably receives a cam-following roller 198, which moves to and fro along a cam track 200. Cam track 200 comprises part of a fast ramp loop 202, which is secured to the central shaft 186 by clamp 204. An adjustment screw 206 spans threadedly between a threaded lug 208 of the clamp 204 and a lug 210 of the fast ramp loop 202 whereby the orientation of the fast ramp loop 202 may be altered (by threadedly adjusting the screw 206 producing a pivoting action at pivot pin 212 between the fast ramp loop 202 and the clamp 204).

Movement of the cam follower 198 along the cam track 200 responsive to variations in the orientation of the air intake plate 184 will produce up and down movement of the arm 192 within the hollow interior of the venturi housing 172 for purposes and to create phenomena as hereinafter more fully described. The forward end 196 of the arm 192 is pivotally joined to pivot pin 214. A sleeve 218 surrounds the leading end 196 of the arm 192 in such a fashion as to permit a limited amount of clockwise and counterclockwise rotation of the arm 192 around the pin 214 as hereinafter more fully explained. The sleeve 218 is biased downwardly by a tension spring 220 which spans between an eyelet 222 forming part of the underside of the sleeve 218 and an eyelet 224 anchored rigidly to the wall 28.

The sleeve 218 is enlarged at its trailing end and there comprises spaced top and bottom substantially horizontal lugs 226 and 228, respectively. Each lug 226 and 228 has a threaded aperture through which a screw 230 passes. The threaded end 232 of each screw 230 comprises an adjustable stop. The location of stop surfaces 232 are respectively adjusted to define the magnitude of clockwise and counterclockwise rotation permitted of arm 192 from the position illustrated in FIG. 1A. Once each screw 230 has been placed in the desired position, an associated locknut 234 is tightened into firm contiguous relation with the associated flange 226 or 228 to retain the stop screws 230 in the desired position.

This rotation permitted of arm 192 defines when the valve end 54 of the rod 50 is closed against the seat 56 or, alternatively, the maximum distance which the valve end 54 is permitted to be separated from the valve seat 56 for fuel flow purposes. Approximately midway between the sites of stops 232 and pivot pin 214 is disposed a collar 240. The previously mentioned metering rod 50 passes slidably through apertures in the collar 240 and threadedly through an aligned aperture in the arm 192. Accordingly, rotation of the arm 192 will move the rod 50 either up or down for the purpose of repositioning the valve end 54 of the rod appropriately to accommodate closure against the seat 56 when the arm 192 is in its down position and to provide the instantaneously optimum maximum opening between the valve head 54 and the seat 56. Once the rod 50 has been threaded to the position desired, lock nut 242 is threaded along the rod 50 into frictionally retained contiguous relation with the upper surface of the boss 240. The rod 50 snugly though reciprocably passes through an aperture 243 in the sloped floor 245 of the fuel cyclone separator 190. The site of aperture 243 is slightly raised to avoid fuel leakage.

Cantilevered actuating lever 216 is rotatably connected to pin 214. The actuating lever 216 is juxtaposed a choke diaphragm mechanism, generally designated 250. Diaphragm mechanism 250 comprises an inverted cup shaped housing 252, which has an upward protrusion 254, a vacuum intake fitting 256 and is rigidly and nonrotatably supported both upon pivot pin 214 and by wall 28 via strut 258. The underside of the diaphragm mechanism 250 is open at opening 260 to expose a vacuum operated resilient diaphragm 262. The peripheral edge of the diaphragm 262 is secured in air tight relation to the housing 252 in any suitable conventional fashion. An external central stop 264 is carried by the diaphragm at its underside and is contiguously engaged by the cantilevered end 266 of the actuating lever 216.

Within the vacuum chamber 268 is carried a spring abutment 270 in alignment with the previously mentioned stop 264 and contiguous with the diaphragm 262. Compression spring 272 is interposed between the stop 270 and an elevated stop 274 carried reciprocably within the hollow 271 of the upwardly directed protrusion 254. The location of spring abutment 274 may be altered by adjusting the location of set screw 276. Set screw 276 passes threadedly through a threaded aperture 278 centrally disposed in the protrusion 254, the threaded end of the set screw 276 engaging the spring abutment 274. When the screw 276 is disposed in the desired position, a lock nut 280 is tightened into binding contiguous relation against the exterior surface of the protrusion 254 to retain the selected position.

Figure 4:
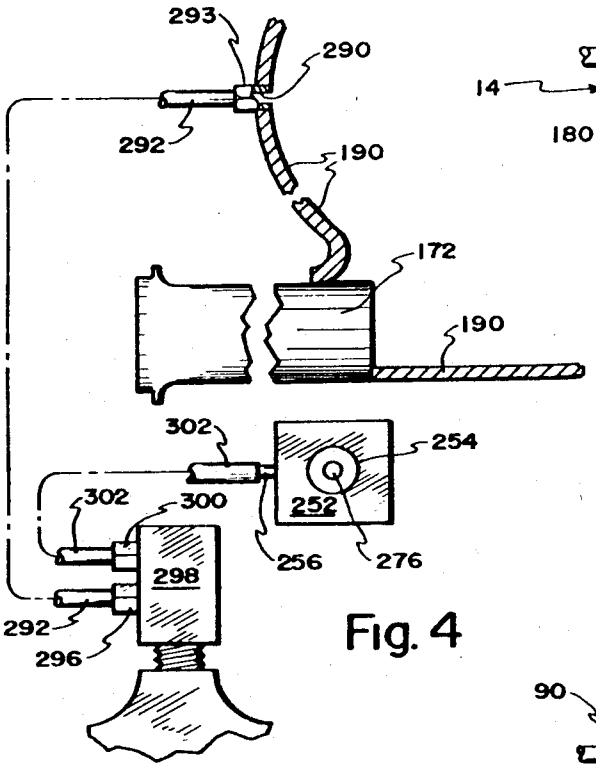
FIG. 4 is a schematic illustration of the manner in which the engine vacuum is communicated to a diaphragm mechanism for minimizing fuel consumption during choke process.

The choke phase can best be described in conjunction with FIG. 4. When the engine is cold, vacuum is communicated from a suitable source 290 and across a fitting 293 through hose 292 into a choke water temperature valve 298 through fitting 296. When the valve 298 is open, the vacuum is further communicated across fitting 300, along hose 302 and across fitting 256 the diaphragm housing 250 and more particularly to the hollow interior 268 thereof. See FIG. 1A. Thus, changes in vacuum pressure will alter the elevation of the diaphragm 262 which will correspondingly rotate the actuating lever 216 clockwise and counterclockwise resulting in corresponding rotation of the metering arm 192 to substantially increase the amount of fuel permitted to pass through the valve seat 56.

Thus, the water temperature valve 298 allows the engine to be choked during periods of low or no vacuum when the engine is cold by causing the metering rod 50 to be displaced toward or into its maximum distance off the seat 56. The choke water temperature valve 298 conventionally senses the temperature of the coolant circulating through the internal combustion engine serviced by carburetor 10. When the coolant temperature reaches a predetermined level, the valve 298 shuts off and ceases to pass the vacuum to the diaphragm mechanism 250, resulting in an upward movement of diaphragm 262, a counterclockwise rotation of arms 216 and 192 around pin 214. In this way the space between valve head 54 and 56 is reduced and less fuel is delivered from the fuel supply 38 to the atomizing section 12.

Preferably, the valve 298 is carried by the cylinder block of the engine so as to be exposed to the coolant within the block. It takes on the order of five minutes to choke a standard carburetor. With the described choke only 15–20 seconds are required. The engine thus will start and run more readily in extremely cold weather. If the mixture is over rich, it is simply recycled as hereinafter explained. Significantly, all of the fuel passageways are full of fuel when the engine is stopped. Thus, the engine will typically start on the first revolution. Excess fuel is recycled during the starting phase in the manner herein explained.

Figure 6:
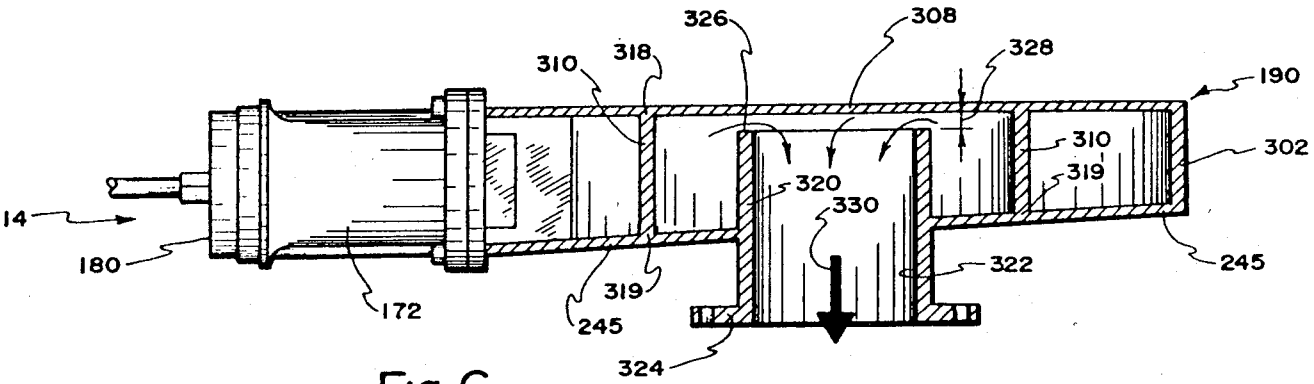
FIG. 6 is a vertical cross section of the fuel recycling cyclone of FIG. 5.
Figure 5:
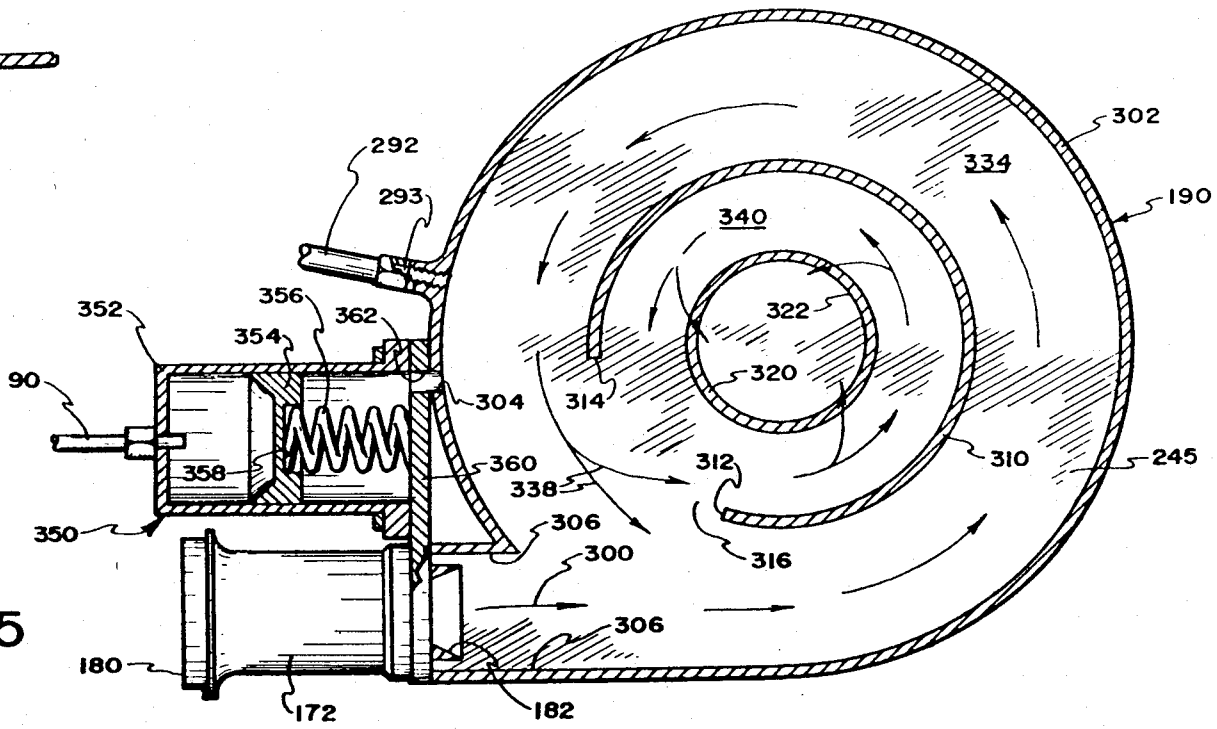
FIG. 5 is a horizontal cross section of the fuel recycling cyclone of the carburetor of FIGS. 1A and 1B.

Particular reference is now made to FIGS. 5 and 6 of the drawings. At substantial speed and turbulence, the main ingress of air carrying with it the fuel/air/fume charge received from the tube 162 as described above is introduced tangentially into the fuel recycling cyclone or vortical fuel separator 190, as best illustrated by arrow 300 (FIG. 5). The fuel recycling housing 190 is exteriorly generally cylindrical in configuration comprising an annular vertically directed wall 302 interrupted by the aperture within the previously mentioned fitting 293, a vacuum aperture 304 and the main intake opening 306. The wall 302 is integral with a bottom wall 245, as by welding.

The housing 190 also comprises a horizontal top 308 which is integrally united along its peripheral edge with the top edge of the cylindrical wall 302 thereby closing in air tight relation the entire top of the fuel recycle housing 190.

The housing 190 further comprises a vertically directed arcuate intermediate wall 310 which traverses approximately 280 arcuate degrees beginning with vertical edge 312 (FIG. 5) and ending at vertical edge 314. Thus, opening 316 is defined between the edges 312 and 314. Edge 312 is substantially linearly aligned with the interior side of the opening 306, while the edge 314 is substantially aligned radially with the opening 304, as illustrated in FIG. 5. The intermediate wall 310 is integrally united along its entire span to the top 308 at site 318 and to bottom 245 at site 319, as by welding or the like.

The housing 190 comprises a central barrel 320 having a circular hollow interior 322 and a mounting flange 324. The mounting flange 324 is adapted to be secured to the intake manifold of an engine with the barrel 320 accommodating intake of fuel/air/fume mixture. The upper end 326 is spaced a predetermined distance 328 (FIG. 6) vertically below the top plate 308 to accommodate flow of the fuel/air/fume mixture over the edge 320 through the hollow 322 of the barrel 320 into the intake manifold as indicated by arrow 330. The barrel 320 is integral with the floor plate 245 at site 331, as by welding, which floor 245 is sloped toward the main air horn or venturi housing 172.

In use, the air/fuel/fume mixture entering the housing 190 as indicated by arrow 300 circulates vortically at high speeds as indicated by the arrows within annular chamber 334. Any remaining non-vaporized or larger particles of fuel are, by centrifugal force, impelled against the interior surface of the wall 302 where these larger particles of fuel are thus caused to accumulate and run down the interior surface of wall 302 and thence along the sloped floor 245 to the fuel return chute 336 (FIG. 1(A) and 1(B). The vortical fuel/air/-fume mixture is bifurcated as indicated by arrows 338, some of which is recycled through annular chamber 334 and the remainder of which is centrifugally and vortically driven through interior chamber 340. Again, any remaining larger particles of fuel are impacted centrifugally against the interior surface of the wall 310, accumulated and caused to flow by force of gravity down the interior surface of wall 310, along the floor 332 and into the chute 336.

All fuel caused to be recycled by use of the cyclone housing 190 is caused to be recycled into the venturi 170 once it passes through the return chute 336 into the passageway 77 between the tube 140 and the annular wall 68. In other words, the force of the crankcase fumes being returned along passage 152 is sufficient to progressively displace the return fuel upward into the chamber 160 and thence through the tube 162 into the venturi 170.

Fully vaporized, atomized and entirely homogeneous fuel/air/fume mixture absent any large particles of fuel is caused by the pressure within the housing 190 to spill from chamber 340 over the top edge 326 into the barrel 320 and thence into the intake manifold. Thus, all excess fuel, which pollutes the atmosphere is recycled without passing through the engine and only fully vaporized fuel reaches the cylinders of the engine. The oil in the gasoline turns into a white vapor that does not wet anything it touches, but still lubricates.

The position of the metering arm 192 illustrated in FIG. 1A depicts the circumstances which exist when the engine is operating at a fixed RPM. When it is desired to accelerate, compression of the accelerator foot pedal (which is connected to the shaft 186) will cause clockwise rotation of the shaft 186 and the throttle plate 184. The indicated rotation will cause the cam 198 to walk upwardly along the cam track 200. This will cause the metering arm 192 to rotate clockwise around pin 214, said motion being limited by engagement between the lever 192 and the stop in 232 of the top set screw 230. The mentioned clockwise rotation of the arm 192 will increase the fuel flow opening between the valve 54 and the main jet valve seat 56. This has the effect of "choking" the carburetor. In other words, the fuel/air mixture becomes enriched to enhance acceleration; the lack of vacuum on the diaphragm also affects this, bringing the arm 192 up against the screw 230.

More specifically, when the car is coasting, the vacuum increases from, for example, 13 to 18 inches of mercury shutting off all of the fuel. When the car accelerates and the vacuum falls off from, for example, 13 to 6 inches of mercury, the metering rod 50 is lifted off of its seat 56. This displacement of the metering rod from its seat by the rise and fall of the diaphragm accelerates and chokes the engine when cold; the throttle plate aids in the choking phase during acceleration when the engine is warm.

A pressure drop occurs during acceleration, requiring the use of an accelerator pump. The suitable accelerating pump is illustrated in FIG. 5 and is generally designated 350. Air is drawn into the interior of the housing 352 of the accelerator pump 350 by motion of the piston 354 thereof in a direction counter to the force of compression spring 356. This occurs when the vacuum of the engine is relatively high.

The ends of compression spring 356 abut the piston 354 (at central recess 358) and base plate 360, which is illustrated as being integral with and rigidly secured against the housing 190. The indicated piston displacement is caused by the application of the mentioned relatively high vacuum pressure to the compression spring side of piston 354 through apertures 362 in plate 360 and aligned aperture 304 in wall 302. Air to fill the side of the housing 352 opposite the spring 356 passes from passageway 98, along passageways 96 and 94 across fitting 92 and through accelerator feed line 90.

Once the relatively high vacuum subsides, namely during acceleration, valve 100 is closed by the force of spring 101 and the piston 554 (FIG. 5) is driven back to its neutral position by the force of spring 356. The air previously accumulated on the left hand side of the piston 354 (as viewed in FIG. 5) is thus displaced into line 90 supplying the atomizing air to the atomizing section for the duration of the acceleration.

On those occasions when the engine is allowed to coast, the vacuum of the engine increases, which causes the previously described diaphragm 262 to flex in an upward direction, as viewed in FIG. 1A. This causes counterclockwise rotation of the metering arm 192 through a maximum distance accommodating engagement of the arm 192 with the stop pin 232 of the stop screw 230 beneath the arm 192. The valve 54 contiguously engages the seat 56, shutting off fuel to the carburetor for the interval of the "coast". The motion of the arm 192 is accommodated by relative displacement of the cam roller 198 along the cam track 200. When the accelerator is again depressed, after a brief interval of acceleration (in the manner described above), normal operation is resumed.

Testing of a prototype of the invention demonstrates a substantial reduction in polluting emissions and a material improvement in fuel efficiency. The test vehicle was a 1974 Ford Ranchero 351 Cleveland Engine having 62,000 miles on the odometer. Before placing the prototype carburetor on the vehicle, the vehicle was equipped with a standard four barrel carburetor which tested as follows: E.P.A. City 9 miles per gallon (6.66 gallons per hour). Highway 13 miles per gallon (4.61 gallons per hour E.P.A.). Pollution was CO 4% and HC 500 PPM, where "HC" is hydrocarbon emissions and "CO" is carbon monoxide emissions. Spark ranged from 5° retard to 20° advance.

After installation of the heretofore described prototype carburetor in accordance with this invention the following static test engine results were obtained: E.P.A. Pollution was CO 0.05% and HC 40 PPM; Gas consumption at idle was as low as 1 hour 36 minutes per gallon (0.62 gallons/hour); Spark ranged from 25° retard to 40° advance.

Dynamic tests of the engine equipped with the mentioned prototype carburetor were conducted, yielding the results tabulated below:

| Speed (MPH) | Time (Min.) | Vacuum (Inches of Hg) | Fuel Consumption (Gals/Hr.) | Fuel Distance (MPG) | Average Fuel Distance (MPG) |
|---|---|---|---|---|---|
| | | FIRST DYNAMIC TEST | | | |
| 20 | 3.6 | 14 in. | 1.66 | 12. | |
| 40 | 3.1 | 12 in. | 1.93 | 20.7 | 17 |
| 50 | 2.2 | 10 in. | 2.72 | 18.3 | |
| | | SECOND DYNAMIC TEST | | | |
| 20 | 4.8 | 14 in. | 1.25 | 16. | |
| 30 | 3.6 | 14 in. | 1.66 | 18. | 18.8 |
| 40 | 3.1 | 14 in. | 1.93 | 20.72 | |
| 50 | 2.5 | 14 in. | 2.40 | 20.8 | |
| | | THIRD DYNAMIC TEST | | | |
| 20 | 5.5 | 14 in. | 1.09 | 18.3 | |
| 30 | 3.8 | 14 in. | 1.57 | 19 | 19.7 |
| 40 | 3.1 | 14 in. | 1.93 | 20.72 | |
| 50 | 2.5 | 14 in. | 2.40 | 20.8 | |
| Idles | | 15 in. | | | |
| | | FOURTH DYNAMIC TEST | | | |
| 20 | 5.6 | 13 in. | 1.07 | 18.69 | |
| 30 | 4.2 | 13 in. | 1.42 | 21.12 | 20.56 |
| 40 | 3.1 | 13 in. | 1.93 | 20.72 | |
| 50 | 2.6 | 13 in. | 2.30 | 21.73 | |

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method of atomizing, vaporizing and homogenizing fuel within a carburetor for an internal combustion engine comprising the steps of:
   - selectively controlling the flow of fuel along a fuel atomizing, vaporizing and homogenizing carburetor flow path;
   - continuously delivering air into the flow path at a plurality of spaced sites therealong;
   - turbulently and vortically comingling air introduced into the flow path with the pre-existing flow at each site for atomizing and vaporizing the fuel and homogenizing the fuel/air mixture without the specific application of heat to the mixture;
   - vortically causing the unvaporized fuel to impinge as a liquid upon a separating surface;
   - re-introducing the separated liquid fuel directly into the atomizing, vaporizing and homogenizing carburetor flow path; and
   - delivering a homogenous mixture of fuel vapor and air into the engine without the specific application of heat to the mixture.

2. A carburetor system for an internal combustion engine comprising:
   - source means for delivery of liquid hydrocarbon fuel;
   - fuel atomizing, vaporizing and air mixing means comprising a plurality of spaced turbulent vortical flow sites disposed seriatim along the flow path thereof and means for introducing a quantity of air into the flow path at each turbulent vortical flow site for atomizing and vaporizing the fuel and homogenizing the fuel/air mixture without the specific application of heat to the mixture;
   - separating means comprising a chamber wherein the fuel/air mixture is vortically circulated causing condensation and accumulation of unvaporized fuel on the interior walls thereof and further comprising gravity flow means by which the separated liquid fuel is returned to the fuel atomizing, vaporizing and air mixing means; and
   - exit means for delivery of a homogenous mixture of vaporized fuel and air to the engine without the specific application of heat to the mixture.

3. A carburetor system according to claim 2 wherein at least one of the turbulent vortical flow sites comprises a cyclonic chamber.

4. A carburetor system for an internal combustion engine comprising:
   - means by which liquid fuel in unaltered form is continuously delivered directly from a source to the input of a carburetor system;
   - means by which said unaltered fuel is initially continuously atomized and the fuel/air mixture derived therefrom is successively further continuously atomized and vaporized using a plurality of streams of secondary air respectively introduced at a plurality of sites one successively downstream of the previous one along the fuel/air flow path within the carburetor system upstream of a site where primary carburetor air is continuously introduced;
   - means at said primary carburetor air site by which primary carburetor air is mixed with repeatedly atomized and vaporized fuel/air mixture;
   - means downstream of the primary carburetor air means but upstream of an intake manifold receiving the resultant discharge comprising the primary air and the atomized, vaporized fuel/air mixture, said downstream means comprising means continuously horizontally vortically separating excess fuel from said discharge and means directly and continuously returning the separated excess fuel to the fuel atomizing and vaporizing means for recycling and means delivering the remaining atomized fuel/primary air mixture to the intake manifold of the engine.

5. A carburetor system according to claim 4 wherein the separating means comprises horizontally disposed cyclonic means in which the discharge is vortically circulated generally in a horizontal plane causing continuous condensation and accumulation of excess fuel on the smooth interior walls thereof without externally supplied heat and further comprising gravity flow means within the carburetor itself by which the separated fuel is continuously recycled directly to the fuel atomizing and vaporizing means.

6. A carburetor system according to claim 4 wherein the separated excess fuel is disposed directly adjacent the primary carburetor-vaporized and atomized fuel mixing site, whereby after shutdown fuel is immediately available to the engine to insure subsequent rapid start-up.

7. A carburetor system for an internal combustion engine comprising:
   - source means for delivery of hydrocarbon fuel;
   - fuel atomizing, vaporizing and air mixing means having a flow path selectively receiving fuel from the source means;
   - primary air means through which primary air is caused to pass and into which the air and fuel from the fuel atomizing, vaporizing and air mixing means are discharged;

means by which fuel/air effluent from the primary air means is caused to be fed into the intake manifold;

the fuel atomizing, vaporizing and air mixing means comprising a plurality of spaced turbulent vortical flow sites disposed seriatim along the flow path thereof and means for introducing a quantity of air into the flow path at each turbulent vortical flow site;

fume recycling means communicating with at least one of said turbulent vortical flow sites and communicating a relatively small quantity of fumes to at least one of said air introducing means whereby fumes and air are caused to be introduced into the flow path at said site.

* * * * *